US008444235B2

(12) United States Patent
Gmerek et al.

(10) Patent No.: US 8,444,235 B2
(45) Date of Patent: May 21, 2013

(54) STORAGE SYSTEM

(75) Inventors: Michael J. Gmerek, Massillion, OH (US); David McNamara, Huntersville, NC (US); Joseph Musser, Huntersville, NC (US); Michael Nicholls, Concord, NC (US); Zach Utz, Uniontown, OH (US); Robert J. Warner, Jr., Charlotte, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 774 days.

(21) Appl. No.: 12/178,406

(22) Filed: Jul. 23, 2008

(65) Prior Publication Data

US 2009/0152217 A1 Jun. 18, 2009

Related U.S. Application Data

(60) Provisional application No. 60/962,113, filed on Jul. 26, 2007.

(51) Int. Cl.
*A47F 5/08* (2006.01)

(52) U.S. Cl.
USPC ..... 312/245; 248/225.21; 248/274.1

(58) Field of Classification Search
USPC ..... 312/242, 245, 246, 198, 111; 248/225.21, 248/223.41, 221.11, 222.11, 274.1; 211/87.01, 211/94.01, 90.04; 52/27, 29, 36.5; 108/152
See application file for complete search history.

(56) References Cited

U.S. PATENT DOCUMENTS 194,971 A * 9/1877 Morgan ..... 312/245
3,113,358 A * 12/1963 Zell et al. ..... 312/263
3,946,979 A * 3/1976 Ehlebracht et al. ..... 248/274.1
3,950,049 A * 4/1976 Drass ..... 312/245
4,008,872 A * 2/1977 Thompson ..... 248/224.61
4,329,003 A * 5/1982 Manchester ..... 312/245
4,457,436 A * 7/1984 Kelley ..... 211/88.01
4,576,355 A * 3/1986 Graf ..... 248/544
5,050,832 A * 9/1991 Lee et al. ..... 248/225.11
5,222,611 A * 6/1993 Wood et al. ..... 211/94.01
5,351,924 A * 10/1994 Schroder ..... 248/274.1
5,351,929 A * 10/1994 Vallance ..... 248/544
5,624,168 A * 4/1997 Licciardello, Sr. ..... 312/245
5,718,493 A * 2/1998 Nikolai ..... 312/245
5,964,438 A * 10/1999 Camilleri ..... 248/225.21
6,113,201 A * 9/2000 Bauer ..... 312/245
2008/0224579 A1* 9/2008 Juten ..... 312/111

OTHER PUBLICATIONS

Closetmaid; http://www.closetmaid.com/Look/GP2/maxload_index.cfm: 2 pages.

* cited by examiner

*Primary Examiner* — James O Hansen
(74) *Attorney, Agent, or Firm* — Dennis J. Williamson; Moore & Van Allen PLLC

(57) ABSTRACT

A storage system is provided comprising a rail mounted to a surface. A cabinet is supported on said rail. At least one engagement member engages the rail to suspend the cabinet from the rail. The cabinet is supported at an angle relative to the surface. An adjustment mechanism is used to adjust the position of the engagement member relative to the rail for adjusting the angle. A method of mounting a cabinet on a surface is also provided comprising mounting a rail having a flange on a surface. A cabinet as described herein is suspended from the rail by the engagement member. The adjustment mechanism is moved towards or away from the surface to adjust the angle of the cabinet.

12 Claims, 7 Drawing Sheets

STORAGE SYSTEM

This application claims benefit of priority under 35 U.S.C. §119(e) to the filing date of to U.S. Provisional Application No. 60/962,113, as filed on Jul. 26, 2007, which is incorporated herein by reference in its entirety.

The invention relates to storage systems and more particularly to wall mounted storage systems.

BACKGROUND

Such wall mounted storage systems are sold by Newell Rubbermaid Inc. under the trademarks FASTTRACK and 300X. These systems comprise a rail or a plurality of rails that are mounted to a substantially vertical supporting surface such as a wall. The rail supports a variety of organizing and storage accessories such as hooks, shelving units and tool holders. The accessories can be removed from and attached to the rail along its length such that the system provides a flexible, reconfigurable storage and organizing system.

SUMMARY OF THE INVENTION

A storage system is provided comprising a rail mounted to a surface. A cabinet is supported on said rail. At least one engagement member engages the rail to suspend the cabinet from the rail. The cabinet is supported at an angle relative to the surface. An adjustment mechanism is used to adjust the position of the engagement member relative to the rail for adjusting the angle.

A cabinet is also provided comprising at least one engagement member and an adjustment mechanism on said engagement member for adjusting said angle. The engagement member may comprise a hook member having a finger for engaging the rail. The hook is movable relative to the cabinet towards and away from said rail. A reinforcement member is aligned with the engagement member such that the cabinet rests on the reinforcement member and the reinforcement member rests on the rail when the cabinet is suspended on the rail.

A method of mounting a cabinet on a surface is also provided comprising mounting a rail having a flange on a surface. A cabinet as described herein is suspended from the rail by the engagement member. The adjustment mechanism is moved towards or away from the surface to adjust the angle of the cabinet.

DESCRIPTION OF EMBODIMENTS OF THE INVENTION

Figure 1:
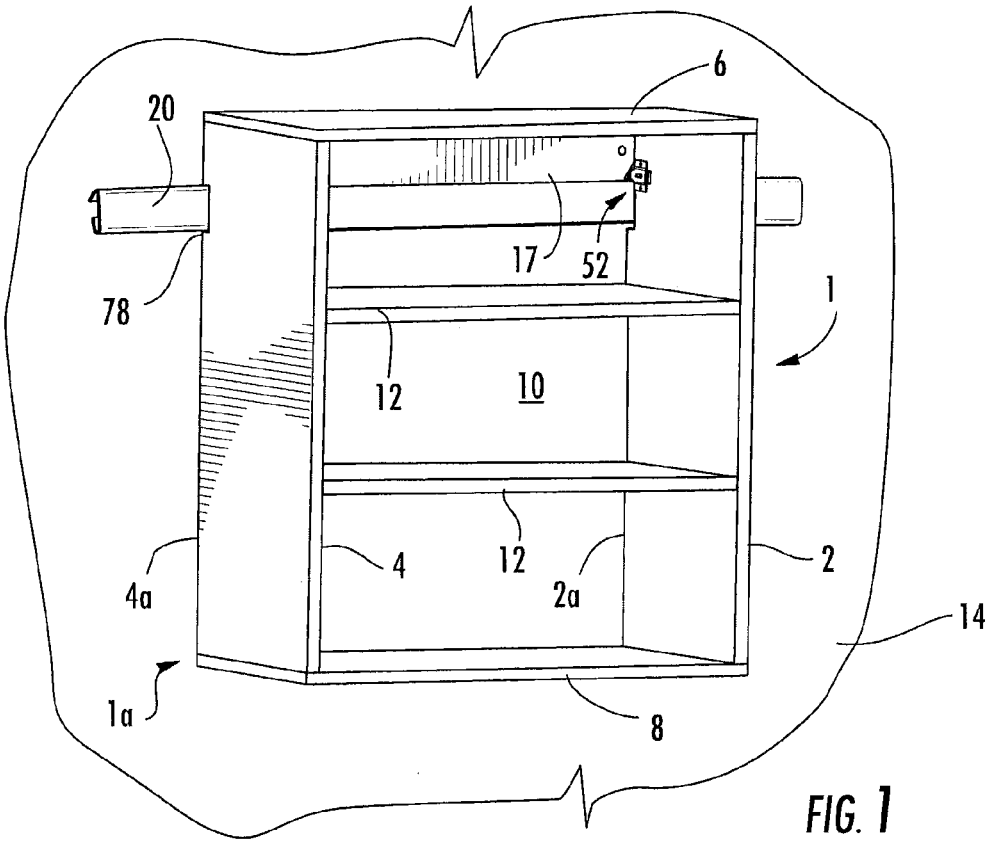
FIG. 1 is a perspective view showing a storage system.

A cabinet 1 for use in a wall mounted storage system such as the FASTTRACK® storage system sold by Newell Rubbermaid, Inc. comprises a pair of opposed side walls 2 and 4 and an opposed top wall 6 and bottom wall 8. The top, bottom and side walls form an internal space 10 suitable for storing and organizing a wide variety of items. The interior space may include shelves 12 or other storage members such as hooks, drawers, or the like. In the illustrated embodiment the internal space 10 is open towards the rear of the unit such that the vertical supporting surface 14 (such as a wall) on which the support rail 20 is mounted forms the back wall of the internal space 10. A reinforcement member 17 is provided to add structural rigidity to the unit and to support the unit as will hereinafter be described. A back wall may be provided to enclose the internal space if desired. Doors may be provided to enclose the interior space 10 such as left and right hand opening hinged doors, a single door, sliding doors, removable covers or the like.

Figure 3:
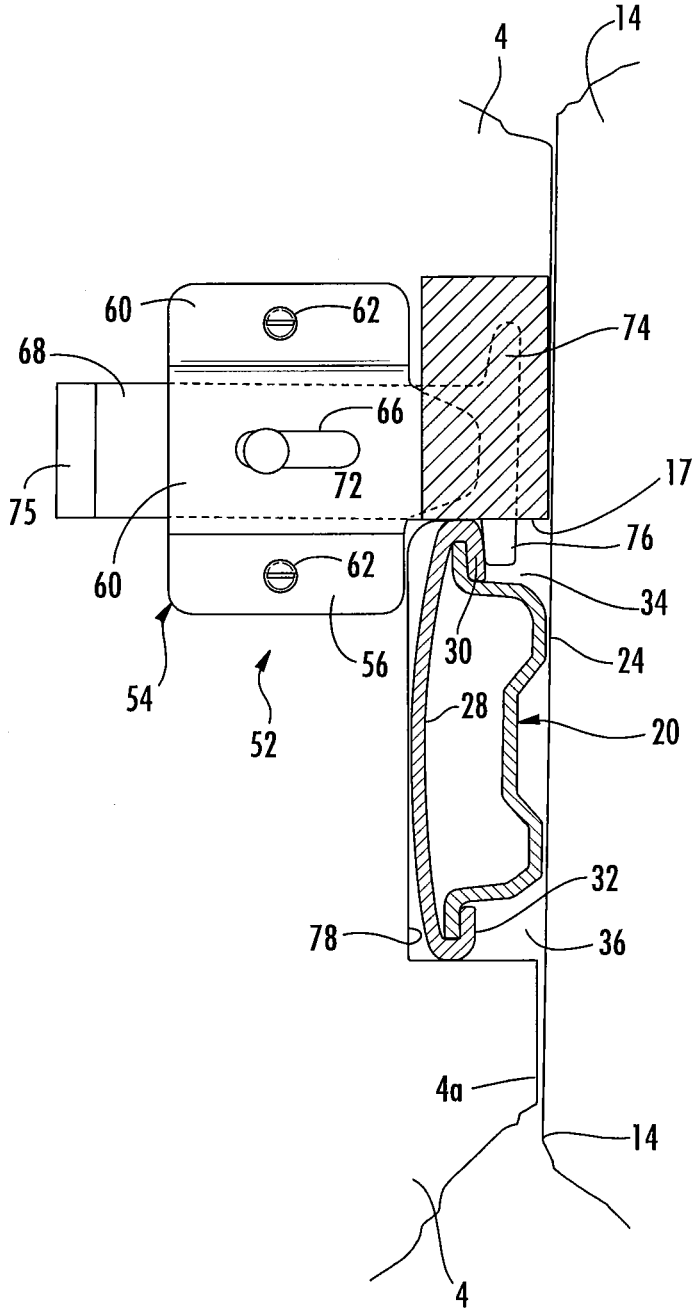
FIG. 3 is a partial section view showing the mounting system used in the storage system of FIG. 1.
Figure 4:
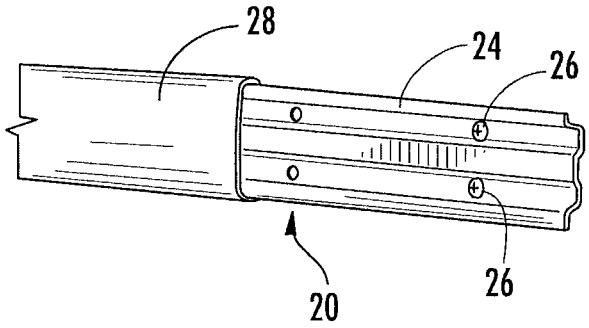
FIGS. 4 and 5 are alternate embodiments of a rail used in the storage system of FIG. 1.

The cabinet is supported on rail 20 that is mounted on a vertical surface 14 such as a wall. Referring to FIGS. 3 and 4, the rail 20 includes a rail portion 24 that is mounted on a wall or other substantially vertical surface by fasteners such as screws 26. Cover portion 28 slides or snaps over rail portion 24. The rail 20 defines an upwardly extending 30 flange and a downwardly extending flange 32 that define longitudinal recesses 34 and 36 between the rail and the vertical surface 14 on which the rail is mounted.

Figure 5:
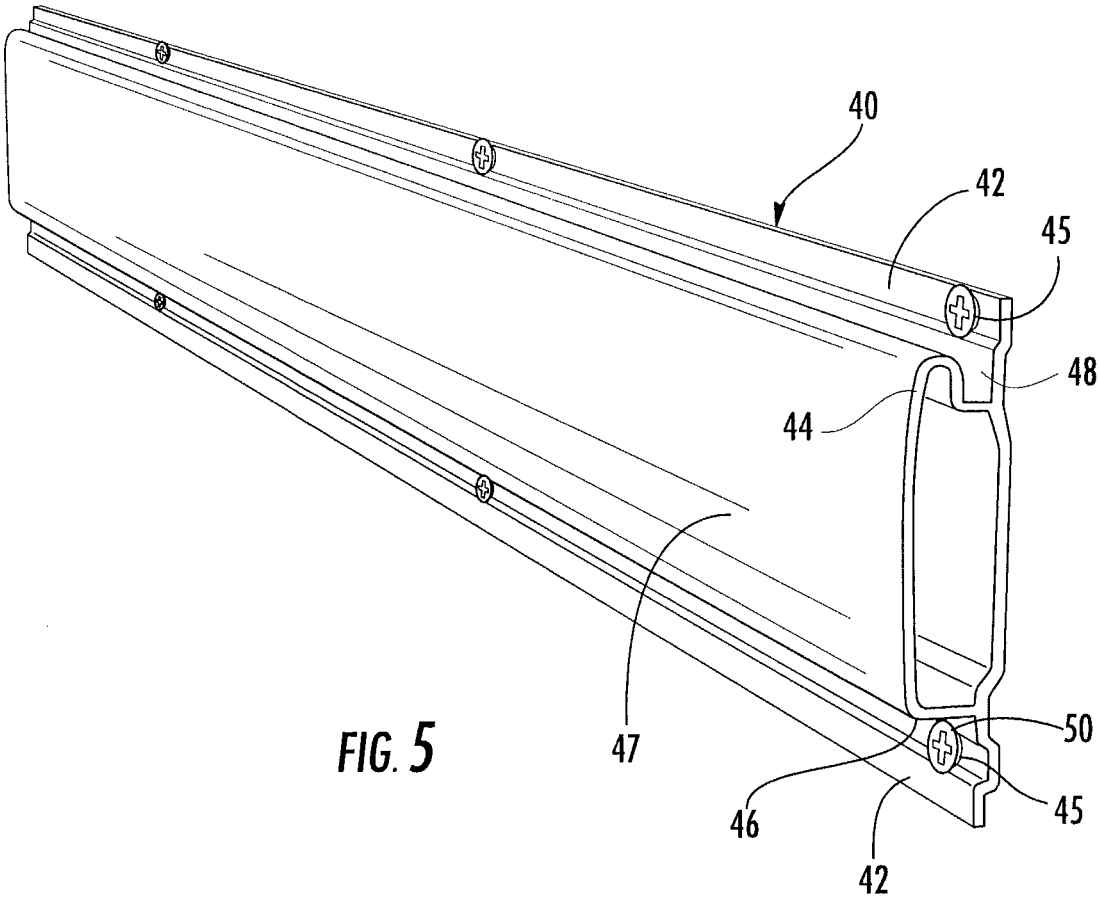

An alternate one piece version of the rail is shown in FIG. 5 that includes a rail 40 having flanges 42 extending the length thereof for receiving screws or other fasteners 45 for mounting the rail to a vertical surface. A centrally located protrusion 47 defines an upwardly extending flange 44 and a downwardly extending flange 46 that define longitudinal recesses 48 and 50 between the protrusion 477 and flanges 42.

To support the cabinet 1 on the rail 20 a pair of adjustable engagement members 52 are provided near the upper edge of the side walls 2 and 4. While only the engagement member 52 on side wall 2 is visible in FIG. 1, it is to be understood that a second engagement member is similarly situated on side wall 4. A fewer or greater number of engagement members 52 may be used depending on the size, shape and weight of the cabinet 1. The engagement members 52 engage the rail 20 such that the cabinet is suspended from the rail adjacent to the wall 14. The cabinet 1 is suspended such that the lower end 1*a* of the cabinet 1 is supported against the wall 14. Because the cabinet 1 is supported near its upper end and the center of gravity of the cabinet is spaced from the supporting surface 14, the lower end 1*a* of the cabinet will tend to pivot about the rail toward and into engagement with surface 14.

In order to mount the cabinet 1 in a substantially vertical orientation, the engagement members 52 include an adjustment mechanism that is used to change the angular orientation of the cabinet 1 relative to surface 14. This adjustment feature permits the cabinet 1 to be properly oriented regardless of variations in the wall and the physical relationship between the rail and the wall.

The engagement members 52 include a bracket 54 mounted to the cabinet 1. In the illustrated embodiment the bracket is mounted to the side walls 2 and 4. The bracket may also be mounted to the top wall 6, reinforcement member 17 or a back wall, if a back wall is provided. The bracket 54 may also be mounted to the outside of the side walls 2 and 4. Further, the bracket 54 may be mounted to the cabinet 1 via an intermediate member such as a reinforcement plate or the like. Other variations in the mounting of brackets 54 to the cabinet 1 are also possible.

The bracket 54 has a first flange 56 and a second flange 58 connected by a body portion 60. The first flange 56 and second flange 58 are coplanar and are arranged such that they can be secured to a surface such as side walls 2 and 4. The flanges 56 and 58 are formed with apertures for receiving fasteners such as screws 62 that engage the flanges to secure the bracket to the cabinet. Other fastening mechanisms for securing the bracket to the cabinet may also be used such as adhesive, rivets, snap fit or the like. The body portion 60 is displaced from the plane of the flanges 56 and 58 such that a space 64 is created between the surface to which the bracket 54 is connected and the body portion 60. A slot 66 is formed in the body portion 60 and is arranged with its longitudinal axis extending substantially perpendicular to the support surface 14 on which the cabinet 1 is mounted.

A hook member 68 is slidably received within space 64 such that it can move relative to the cabinet in a direction parallel to slot 66 and perpendicular to the support surface 14 on which the cabinet is mounted. The hook member 68 includes a threaded aperture 70 that receives a threaded screw 72. The hook member 68 may be fixed in position relative to bracket by screw 72 that engages threaded aperture 70 and traps the bracket 54 between the head of the screw and the hook member 68. The screw 72 can be tightened against the bracket 54 to hold the hook member 68 in a fixed position relative to the bracket 54 and cabinet 1. Hook member 68 includes a flange 75 that extends perpendicularly from the main body of the hook member and is dimensioned such that it cannot pass through space 64. Flange 75 prevents the hook member 68 from completely withdrawing from bracket 54 even if screw 72 becomes loose. This arrangement prevents the cabinet from falling from the support surface 14 even if screw 72 fails or becomes loose.

The hook member 68 includes fingers 74 and 76 that extend therefrom substantially perpendicular to the sliding direction of the hook member and substantially parallel to the support surface 14 on which the cabinet is mounted. One of the fingers 76 is dimensioned such that it extends into recess 34 formed along the upper surface of rail 20. A cut out 78 may be formed in each of side walls 2 and 4 such that the rail 20 is received in the cut outs 78 and the back edges 2*a* and 4*a* of side walls 2 and 4, respectively, are disposed closely adjacent to the supporting surface 14. When hook members 68 are engaged with the rail 20, the rail 20 is trapped between the side walls 2 and 4, the vertical supporting surface 14 and the hook members 68 such that the cabinet is suspended on the rail 20 by the hook members 68. The reinforcement member 17 is dimensioned such that the lower edge of the reinforcement member rests on top of the rail 20 when the hook members 68 engage the rail such that the reinforcement member 17 spreads the load of the cabinet and its contents across the rail 20 for the length of the reinforcement member.

The position of the hook members 68 relative to the back of the cabinet may be adjusted by loosening screw 72, sliding hook member 68 relative to bracket 54 and retightening screw 72 to fix the hook member 68 relative to bracket 54 and cabinet 1. When the hook members 68 are extended or retracted relative to the cabinet, the cabinet will pivot about its lower end 1*a* that is in contact with the support surface 14, to thereby adjust the angle of the cabinet relative to the support surface 14. This adjustment allows the cabinet 1 to be suspended from the rail 20 and occupy a relatively vertical alignment even if the support surface 14 is at an angle relative to vertical or has an uneven surface. Because the engagement members 52 are located at the opposite side walls they can be adjusted to adjust each side of the cabinet independently of the other side of the cabinet to account for irregularities in the vertical surface.

Figure 2:
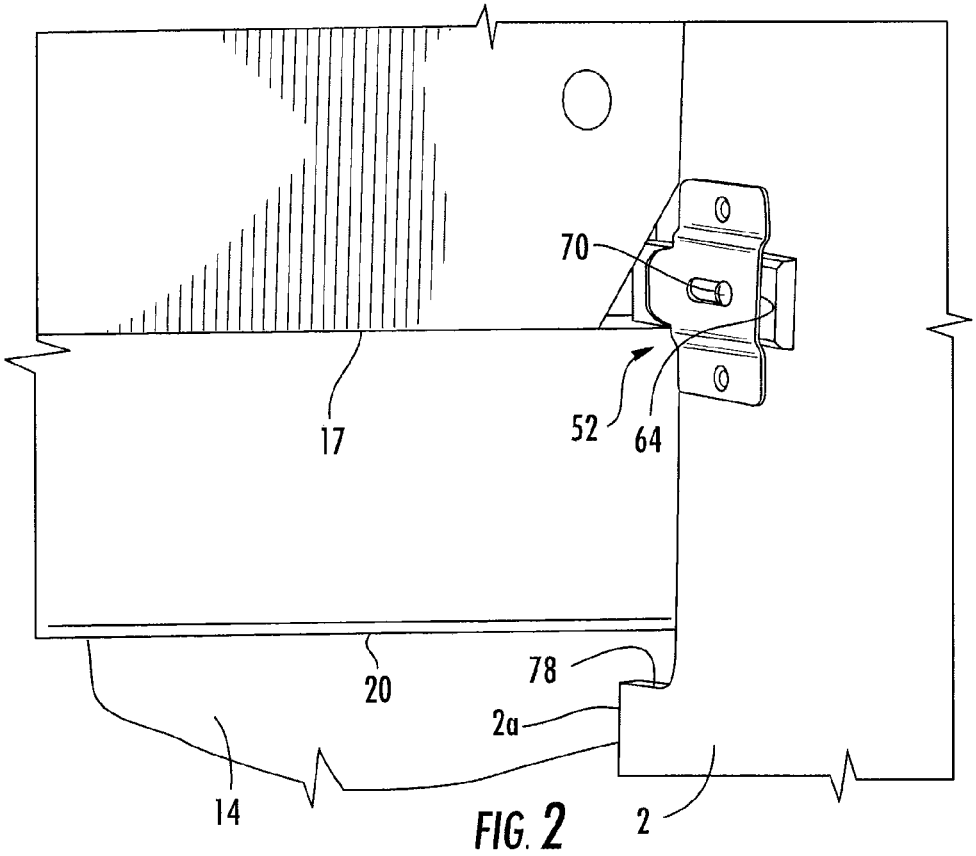
FIG. 2 is a perspective view showing the mounting system used in the storage system of FIG. 1.
Figure 6:
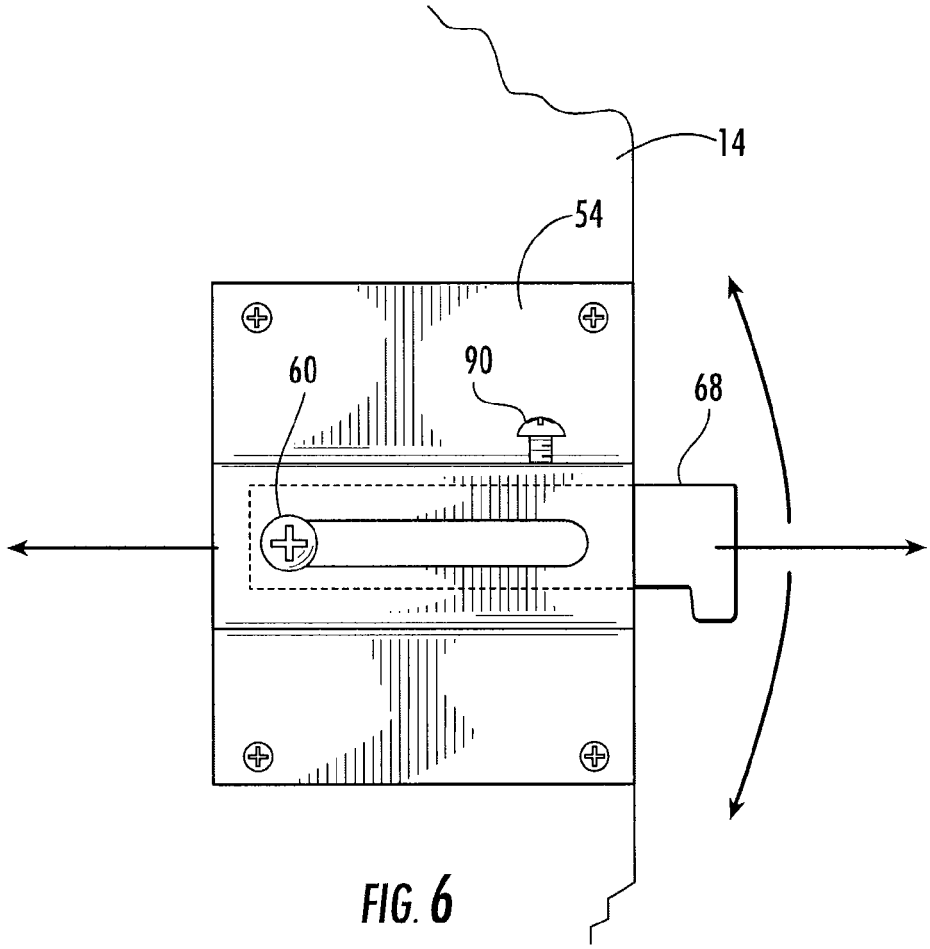
FIG. 6 is a side view of another embodiment of the engagement member of the invention.
Figure 7:
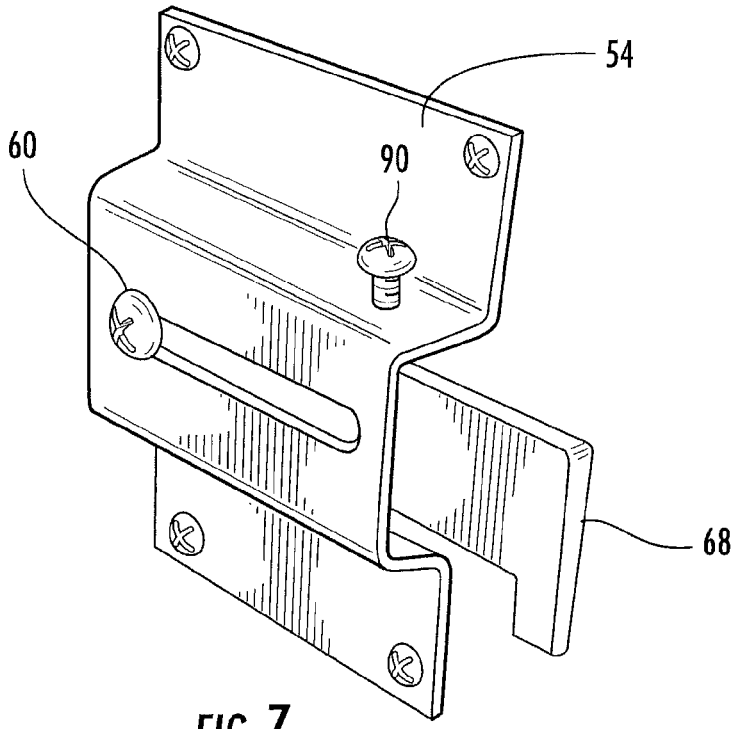
FIG. 7 is a perspective view of the engagement member of FIG. 6.

An alternate embodiment of the engagement members is shown in FIGS. 6 and 7 that is similar to the embodiment of the engagement members described with respect to FIGS. 1 through 3 where like reference numerals are used to identify like components. In the embodiment of FIGS. 6 and 7 a second screw 90 is positioned in bracket 54 such that it extends transverse to the first screw 60 and is parallel to the vertical support surface 14. Screw 90 engages an edge of the hook member 68. The screw 90 may be tightened or loosened to engage the hook member and change the angle of the hook member 68 relative to bracket 54. Changing the angle of the hook member 68 relative to bracket 54 changes the angle of the cabinet relative to the vertical support surface 14. The screw 90 could also be arranged to engage the bottom of the hook member 68. Further, additional screws engaging either or both of the top and bottom edges of hook member 68 may be used if desired.

Figure 8:
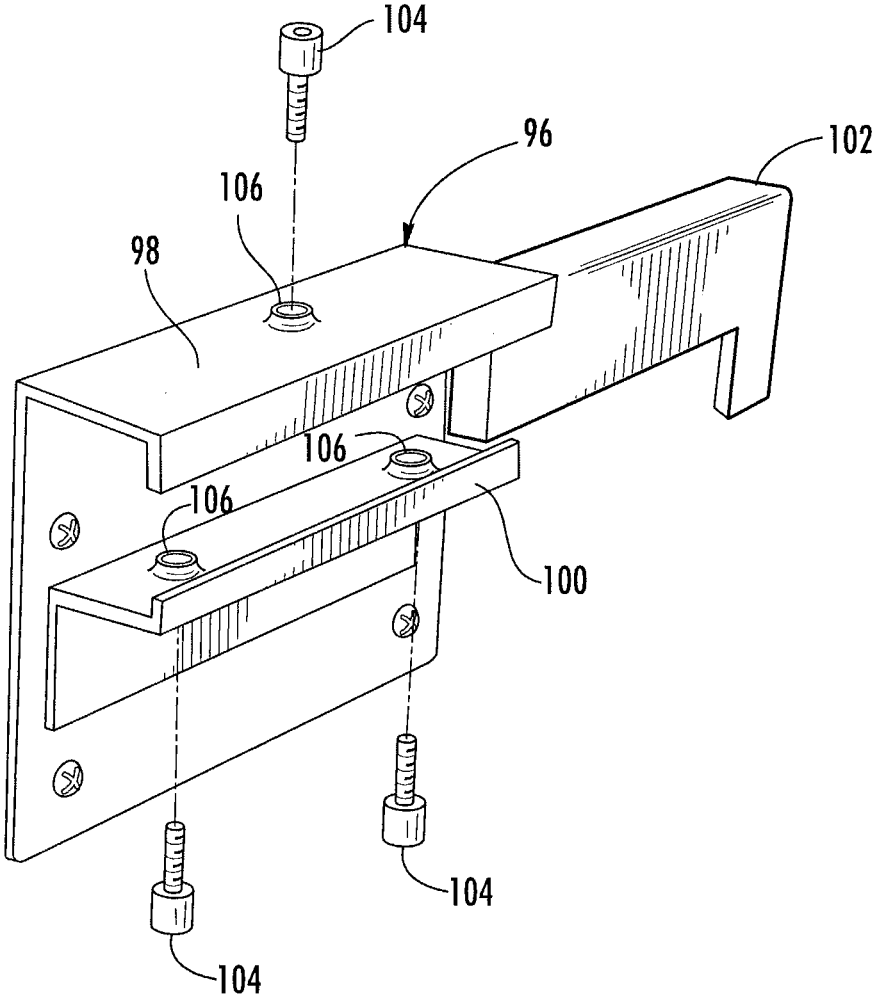
FIG. 8 is a perspective view of another embodiment of the engagement member of the invention.

Another alternate embodiment of the engagement members is shown in FIG. 8 where the bracket 96 that is attached to the side walls 2 and 4 of the cabinet includes an upper flange 98 and a lower flange 100 arranged to slidably receive a hook member 102. A plurality of screws 104 threadably engage threaded apertures 106 formed in the flanges 98 and 100 that may be tightened into engagement with the hook member 102 to retain the hook member 102 in the bracket 96. The hook member 102 can be positioned in the bracket 98 to vary the spacing of the hook member 102 from the back of the cabinet. The screws 104 can also be selectively tightened to vary the angle of the hook member 102 relative to the bracket to thereby adjust the angle of the cabinet relative to the vertical supporting surface.

Figure 9:
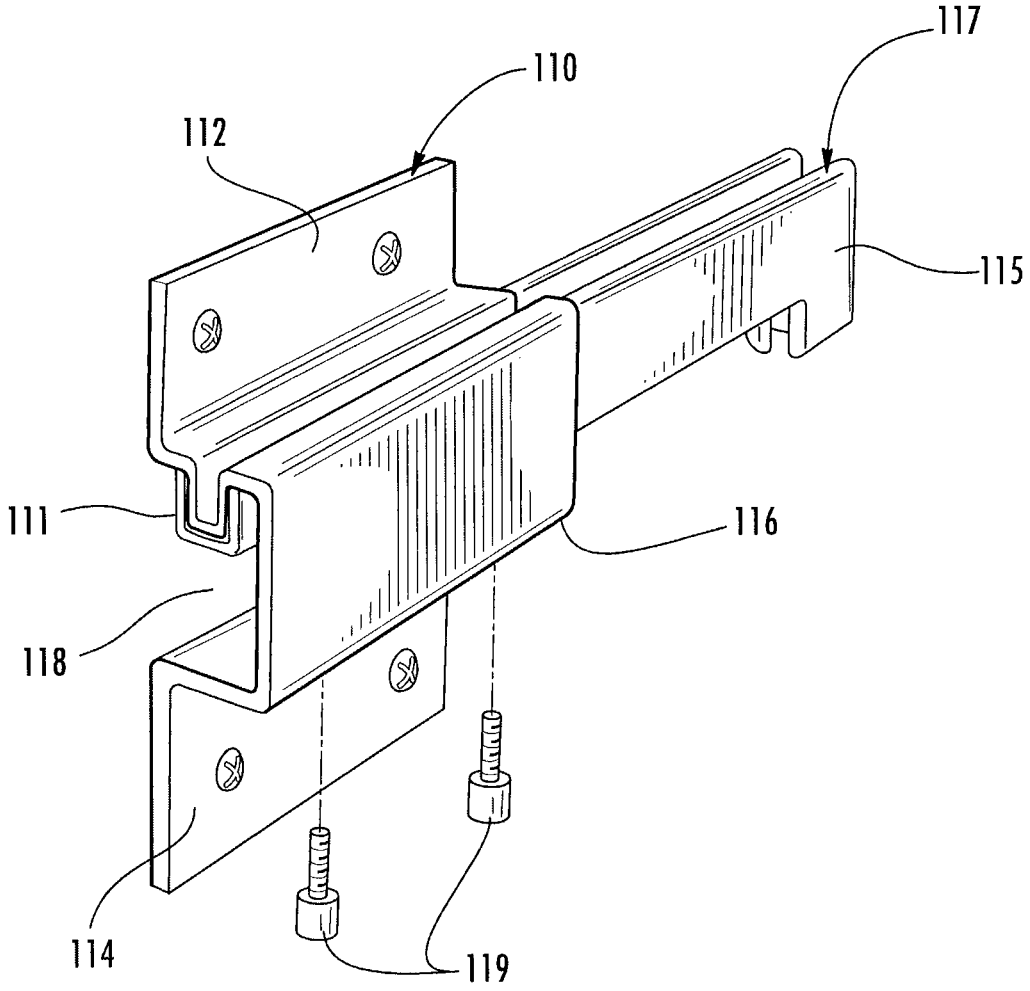
FIG. 9 is a perspective view of yet another embodiment of the engagement member of the invention.

FIG. 9 shows an alternate embodiment of the engagement members. The engagement members include a bracket 110 mounted to the side walls 2 and 4 of the cabinet. The bracket 110 has a first flange 112 and a second flange 114 connected by a body portion 116. The first flange 112 and second flange 114 are coplanar and are arranged such that they can be secured to a surface such as side walls 2 and 4. The flanges 112 and 114 are formed with apertures for receiving fasteners such as screws that secure the bracket to the cabinet. The body portion 116 is displaced from the plane of the flanges 112 and 114 such that a space 118 is created between the surface to which the bracket 110 is connected and the body portion 116. A protrusion or rail 111 is formed in one of flanges 112 and 114 and is arranged with its longitudinal axis extending substantially perpendicular to the support surface 14 on which the cabinet 1 is mounted.

A hook member 115 is slidably received within space 118 such that it can move relative to the cabinet in a direction perpendicular to the support surface 14 on which the cabinet is mounted. The hook member 115 includes a slot 117 that receives rail 111. The hook member 115 may be fixed in position relative to bracket by screws 119 that engage an edge of the hook member 115. Screws 119 can be tightened against the hook member 115 to hold the hook member 68 in a fixed position relative to the bracket and cabinet. The screws 119 can also be selectively tightened to vary the angle of the hook member 115 relative to the bracket 110 to thereby adjust the angle of the cabinet relative to the vertical supporting surface.

Figure 10:
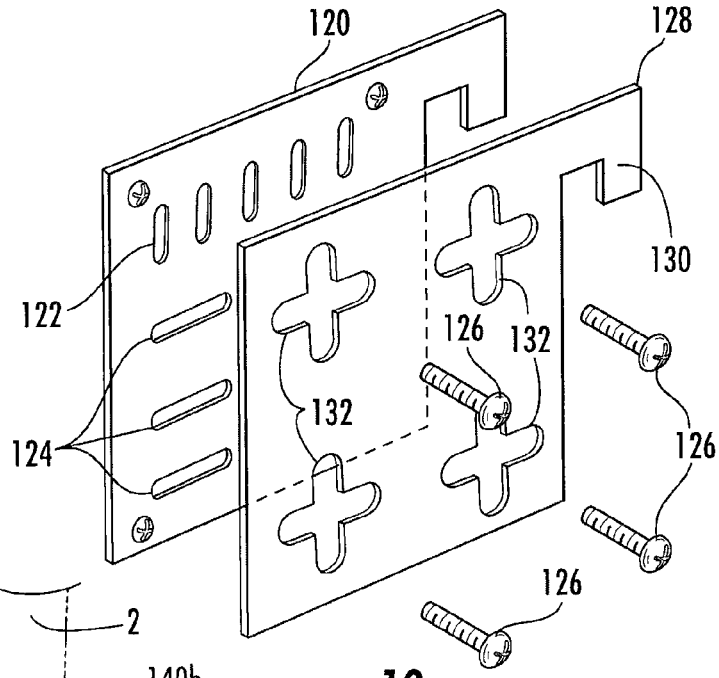
FIG. 10 is a perspective view of yet another embodiment of the engagement member of the invention.

Another embodiment of the engagement member is shown in FIG. 10 where a first support plate 120 is mounted to the side walls 2 and 4 of the cabinet and includes a plurality of threaded apertures 122 and 124 that receive fasteners such as threaded screws 126. A second hook plate 128 having a hook member 130 formed at end thereof includes a plurality of holes 132 for receiving the fasteners 126. The fasteners 126 may be inserted through the holes 132 to engage apertures 122 and 124 formed on the support plate 120. The screws 126 are tightened to trap the hook plate 128 between the support plate 120 and the screws in the desired position. The apertures 122 and 124 may be made as slots arranged vertically, horizontally or at an angle and the holes 132 may be arranged as a cross-shaped slot to allow the hook plate 128 to be selectively positioned on the support plate 120 to thereby adjust the spacing and the angle of the cabinet relative to the vertical supporting surface.

Figure 11:
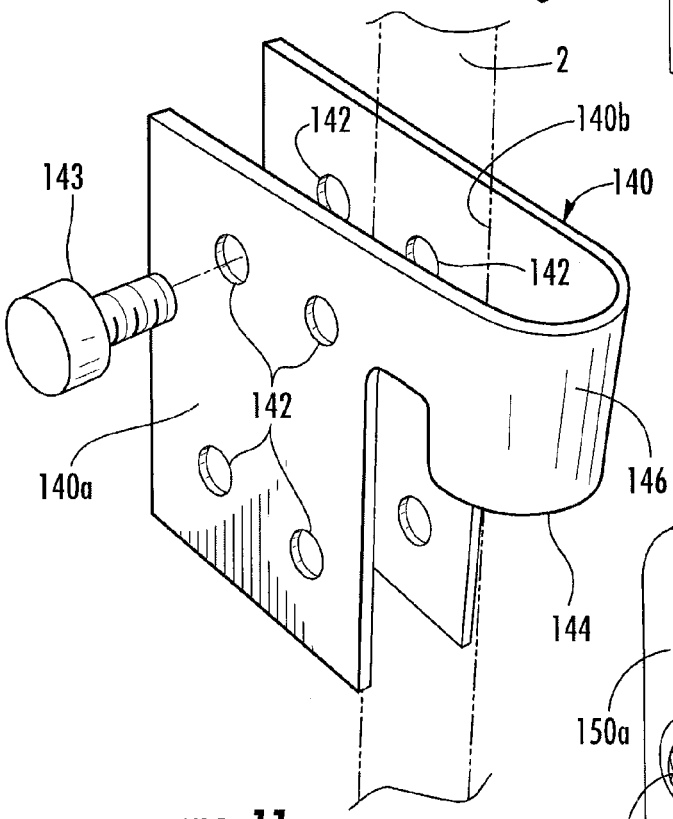
FIG. 11 is a perspective view of yet another embodiment of the engagement member of the invention.

Another embodiment of the engagement member is shown in FIG. 11 where a support member 140 is formed to have a U-shaped profile that fits over the side walls 2 and 4 of the cabinet such that the side wall is located between first leg 140*a* and second leg 140*b*. A plurality of screw holes 142 are formed in the legs 140*a* and 140*b* that may be aligned with a plurality of holes formed in the cabinet side walls 2 and 4 and connected thereto by fasteners 143 such that the position of the support member 140 relative to the side walls may be adjusted vertically and horizontally. A hook member 144 is connected to support member 140 and may be formed integrally with the legs 140*a* and 140*b* as part of the wall 146 that joins the two legs 140*a* and 140*b* to one another.

Figure 12:
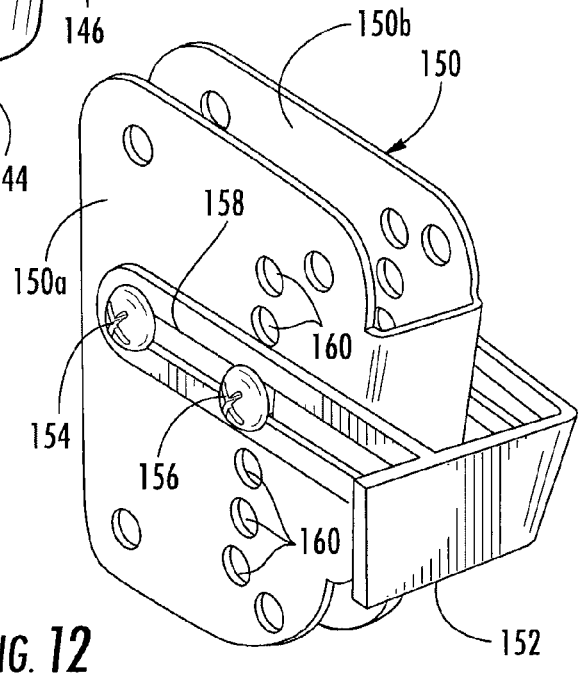
FIG. 12 is a perspective view of still another embodiment of the engagement member of the invention.

Another embodiment of the engagement member is shown in FIG. 12 where a rigid support member 150 is formed to have a U-shaped profile that fits over the side wall of the cabinet such the side wall is located between first leg 150*a* and second leg 140*b*. The support member 150 is mounted to the side walls 2 and 4 of the cabinet in a fixed position. A hook member 152 is formed as a separate element from the support member 150 and is connected thereto by fasteners 154 and 156. Fastener 154 is secured in a fixed location of the support member and fastener 156 may be located in one of a plurality locations on the support member. The hook member 152 includes a slot 158 that is engaged by the fasteners 154 and 156 such that the horizontal position of the support member relative to the vertical support surface may be adjusted. The fasteners 154 and 156 are loosened such that the hook member 152 may be extended or retracted from the support member 150 by sliding the slot 158 over the fasteners. The fasteners are then tightened to retain the hook member 152 in the desired position. The angle of the hook member 152 relative to the support member 150 may also be adjusted by locating fastener 156 in a selected one of the plurality of mating apertures 160. The position of the hook member 152 relative to the support member 150 and cabinet side walls 2 and 4 may be adjusted vertically and horizontally.

To mount the cabinet on a surface, a rail having a flange such as described herein is mounted to a surface. A cabinet as described herein having at least one engagement member and an adjustment mechanism on said engagement member for adjusting said angle is suspended from the rail. The engagement member engages the flange and the cabinet is supported at an angle relative to the surface. The adjusting mechanism is moved towards or away from the surface to adjust said angle. The angle of the adjusting mechanism relative to the cabinet can also be adjusted. The reinforcement member 74 that is secured to the cabinet may be rested on the top of the rail to spread the weight of the cabinet along the length of the rail.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A cabinet for being supported on a rail mounted on a surface comprising: a single rail mounted on a surface where the surface is disposed substantially vertical, the cabinet having a center of gravity and being suspended from the rail by at least one engagement member, the at least one engagement member comprising a bracket mounted to the cabinet adapted to receive a hook member, the hook member being separate from the bracket and movably received in the bracket, the at least one engagement member being provided near an upper end of the cabinet for suspending the cabinet from the rail such that the center of gravity of the cabinet will tend to pivot a lower end of the cabinet toward the surface such that the lower end of the cabinet contacts the surface, said cabinet being supported at a variable angle relative to said surface; the hook member engaging the rail where the hook member is movable relative to the cabinet toward and away from the rail to move the upper end of the cabinet toward and away from the rail and to pivot the cabinet about the lower end where the lower end remains in contact with the surface as the upper end of the cabinet moves toward and away from the rail for adjusting said variable angle, and further including a reinforcement member fixed to the cabinet that is aligned with the at least one engagement member such that the reinforcement member rests on the rail when the cabinet is suspended on the rail.

2. The cabinet of claim 1 wherein the hook member comprises a finger for engaging the rail.

3. The cabinet of claim 1 further including a means for fixing the hook member relative to the bracket.

4. The cabinet of claim 1 further including a fastener for fixing the hook member relative to the bracket.

5. The cabinet of claim 1 wherein said hook member includes a flange that engages the bracket to prevent the hook member from being completely withdrawn from the bracket.

6. The cabinet of claim 1 wherein the at least one engagement member comprises a first engagement member and a second engagement member provided near an upper end of the cabinet for suspending the cabinet from the rail.

7. The cabinet of claim 6 wherein the second engagement member is independently adjusted from the first engagement member.

8. The cabinet of claim 6 wherein the second engagement member and the first engagement member are located on opposite side walls of the cabinet.

9. The cabinet of claim 1 wherein the at least one engagement member is mounted to the cabinet via an intermediate member.

10. The cabinet of claim 1 wherein the hook member moves perpendicularly to the surface.

11. The cabinet of claim 1 wherein the bracket comprises a slot that receives a threaded member that engages the hook member.

12. The cabinet of claim 1 wherein the hook member is dimensioned such that when the hook member is engaged with the rail the rail is trapped between the cabinet and the hook member.

* * * * *